US005626517A

United States Patent [19]

Kil

[11] Patent Number: 5,626,517

[45] Date of Patent: May 6, 1997

[54] AIR VENT CONTROL APPARATUS

[75] Inventor: Yong H. Kil, Suwon, Rep. of Korea

[73] Assignee: Samsung Electronics Co., Ltd., Suwon, Rep. of Korea

[21] Appl. No.: 403,272

[22] Filed: Mar. 13, 1995

[30] Foreign Application Priority Data

Aug. 11, 1994 [KR] Rep. of Korea ..... U. M. 94-20298

[51] Int. Cl.[6] ..... F24F 13/075

[52] U.S. Cl. ..... 454/315; 454/319

[58] Field of Search ..... 454/155, 202, 454/313, 315, 319, 321

[56] References Cited

U.S. PATENT DOCUMENTS

| | | | |
|---|---|---|---|
| 4,043,258 | 8/1977 | Zitko et al. | 454/319 |
| 4,621,570 | 11/1986 | Bolton et al. | 454/202 X |

FOREIGN PATENT DOCUMENTS

| | | | |
|---|---|---|---|
| 2208259 | 8/1973 | Germany | 454/319 |
| 2210782 | 9/1973 | Germany | 454/319 |
| 626325 | 9/1978 | U.S.S.R. | 454/319 |
| 171946 | 12/1921 | United Kingdom | 454/319 |

*Primary Examiner*—Harold Joyce

*Attorney, Agent, or Firm*—Burns, Doane, Swecker & Mathis, L.L.P.

[57] ABSTRACT

A flow of air from an air discharge passage has its direction of flow controlled by a series of louvers arranged to swing horizontally back and forth. Each louver has a hinge pin rotatably supported to form an axis of rotation. A connecting member interconnects a plurality of the hinge pins to transmit rotational movement between those hinge pins. The connecting member is attached to each hinge pin by a flexible connection enabling the hinge pin to rotate relative to the connecting member. The connecting member is disposed within a member which shields the connecting member from the air flow.

7 Claims, 6 Drawing Sheets

AIR VENT CONTROL APPARATUS

BACKGROUND OF THE INVENTION

This invention relates to an air vent control apparatus, and more particularly to an air vent control apparatus in which a connecting member is provided for simultaneously moving a plurality of horizontal swing louvers.

An ordinary air conditioner is shown in FIGS. 6 and 7. An air intake opening 1 is formed at the upper portion of a front surface while a discharge opening 2 is formed at the lower portion of the front surface. Behind the front surface are mounted a heat exchanger (not shown) in which refrigerant being in a state of low pressure and temperature and thus suitable to be evaporated is flowed, and a fan (not shown) for circulating the indoor air. Further, behind the discharge opening 2 are provided vertical swing louvers 3 and horizontal swing louvers 4.

In the air conditioner, as the fan rotates, the indoor air is drawn through the intaking opening 1 and the temperature of the indoor air is lowered while passing the heat exchanger. Further, the cool air is discharged through the discharge opening 2, thus cooling the indoors. At this time, the air flow with respect to the vertical or the horizontal direction is controlled by corresponding swing louvers 3,4.

Next, the conventional air vent apparatus, shown in FIG. 7, comprises an upper 5 and a lower plate 6 defining the discharge opening 2, a hinge pin 4*a* protruded at the rear of the upper portion of respective horizontal swing louvers 4, a bushing 7 fitted on the hinge pin 4*a*, an opening 5*a* formed in the upper plate 5 for receiving the bushing 7, and a pin 4*b* protruded at the front of the upper portion of respective horizontal swing louvers 4. The air vent apparatus further comprises a connecting bar 8 for linking together a plurality of pins 4*b* and for controlling simultaneously those pins 4*b*, and an auxiliary connecting bar 9 fitted into a slot 4*c* formed at the upper portion of the horizontal swing louvers 4.

In the conventional air vent control apparatus, the hinge pin 4*a* is preliminarily inserted into the opening 5*a*, and the bushing 7 is force-fitted into the opening 5*a* so as to frictionally grip the hinge pin 4*a*. Next, a plurality of pins 4*b* of one set of louvers 4 are linked with each other by the connecting bar 8, and the auxiliary connecting bar 9 is fitted through the slot 4*c* formed in a louver 4 of that set of horizontal swing louvers 4 and also through the slot 4*c'* formed in a louver 4' of a neighboring set of horizontal swing louvers 4'. That creates the simultaneous swinging of the two sets of louvers 4,4'.

That is, in the air vent control apparatus, when one swing louver 4 is horizontally moved, a plurality of louvers 4,4' of a plurality of sets of are simultaneously moved in a horizontal swing direction by the connecting bar 8 and the auxiliary connecting bar 9. The direction of air flow can thus be changed.

However, because the connecting bar 8 and the auxiliary connecting bar 9 are exposed to the air flow of the air discharge opening 2, the outflowing air is hindered by the connecting bar 8, 9 located in the outflowing air opening 2. That produces the problem that the air flow noise is increased and the volume of air flow is reduced due to the obstructing bars 9.

Further, due to irregularities on the contacting surfaces of the pins on the louvers, the openings on the upper plates and the bushing 7, a smooth fit may not be established. Accordingly, the louver may be set to a position offset from the intended position. Such an offset contributes to the noise problem. Additionally, the louvers may swing about its axis in an unsmooth manner.

Furthermore, amount of assembly time necessary for inserting pins 4*a* and 4*b* of each of the louvers into openings in the upper plate 5 and connecting bar 8, respectively, is significantly long. Thus, productivity is not optimized.

SUMMARY OF THE INVENTION

An object of the present invention is to provide an air vent control apparatus which solves the above problems.

Another object of the present invention is to provide an air vent control apparatus in which the connecting members for simultaneously moving respective horizontal swing louvers are no exposed in the air flow to avoid interference with the outflowing air.

Another object of the present invention is to provide an air vent control apparatus in which respective horizontal swing louvers are detachably assembled with a minimal tolerance, thereby reducing the operational noise of a fan.

Another object of the present invention is to provide an air vent control apparatus in which the assembly between pins formed in respective louvers and a connecting member for fastening the pins is improved by simplifying the connecting structures for the benefit of a smoother rotation of the horizontal swing louvers and reducing the assembly time.

According to the present invention, the air vent control apparatus comprises a plurality of horizontal swing louvers, hinge pins formed on respective louvers for hingedly swinging said louvers, a supporting member for rotatably supporting the hinge pins, and a connecting member for integrally connecting a plurality of hinge pins.

Further, the pins are supported in openings defined cooperatively by detachable fitting components.

Further, the connecting member is encircled by a fixing member to be shielded from the flow of the discharging air.

Furthermore, the air vent control apparatus further comprises a directional setting means for controlling the direction of the outflowing air.

DESCRIPTION OF THE PREFERRED EMBODIMENTS

Figure 1:
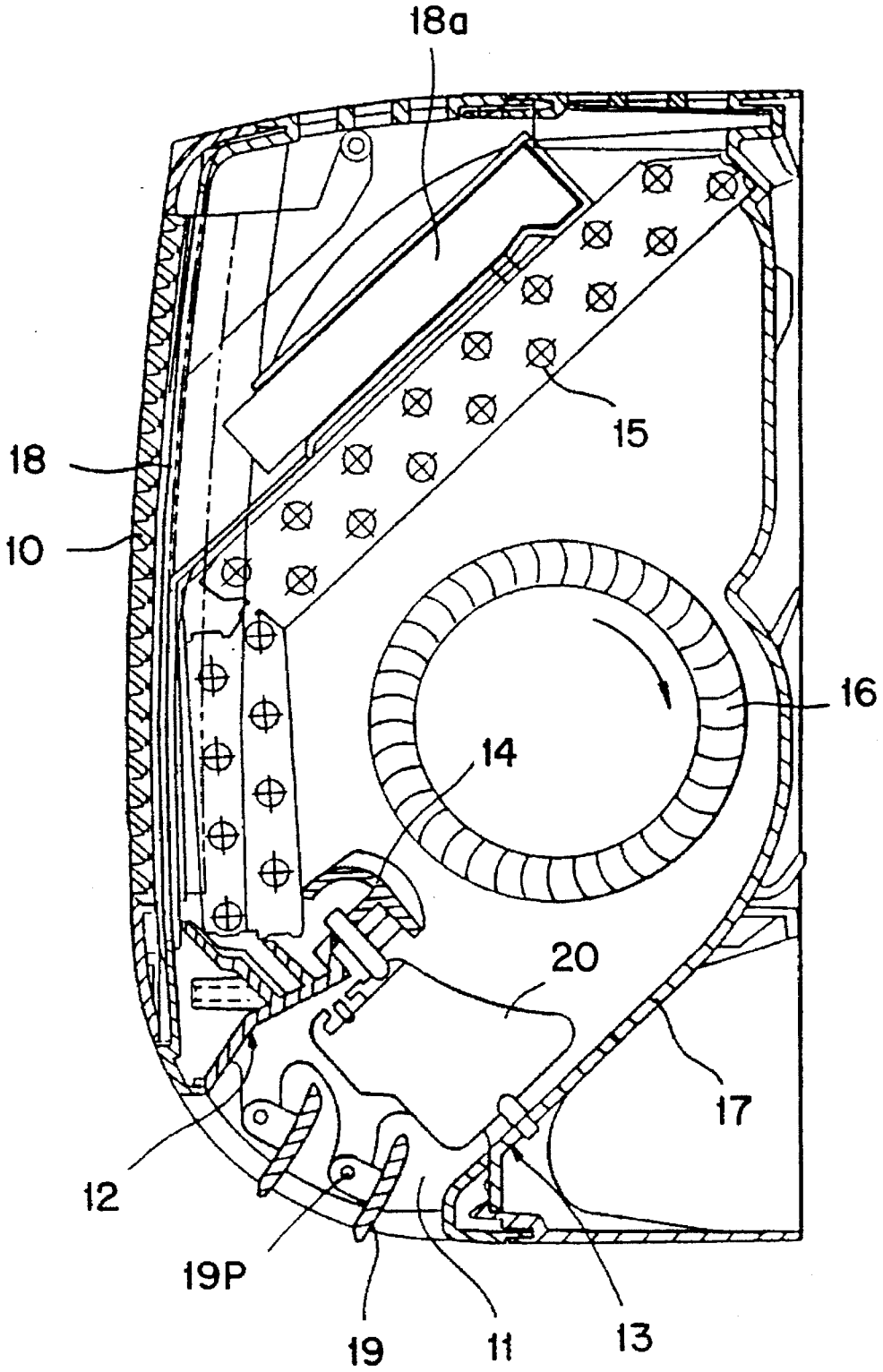
FIG. 1 is a vertical sectional view of an indoor unit of an air conditioner having an air vent control apparatus according to the present invention.

In FIG. 1, an indoor unit of an air conditioner comprises an air intaking opening 10 and an air discharging opening 11 which are disposed above and below a heat exchanger 15, respectively, at fan 16 a front portion of the unit A is rotatably mounted behind and to the rear of the heat exchanger 15. The indoor unit further comprises a horizontal swing louver 20 and a vertical swing louver 19 which are hingedly mounted at the discharge opening 11 for controlling the air flow direction, and a guide plate 17 encircling the rear portion of the fan 16 for guiding the heat-exchanged air toward the discharge opening 11. The heat exchanger 15 is bent to form upper and lower portions, and an air cleaner 18*a* is placed on the upper portion of the heat exchanger 15. At the rear surface of the intaking opening 10 is installed a filter 18 for collecting dust.

Figure 2:
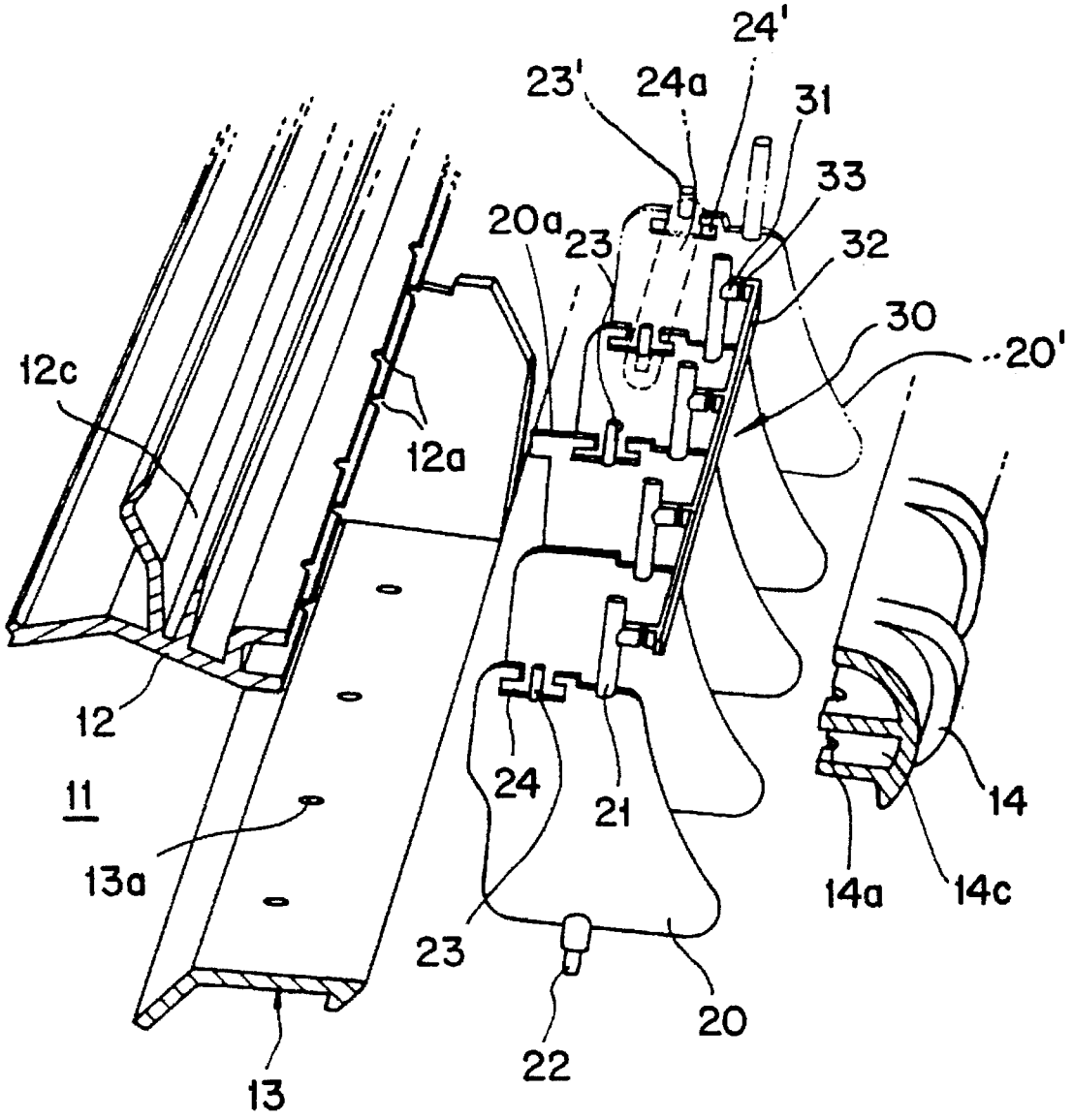
FIG. 2 is a perspective exploded view of the air vent control apparatus of FIG. 1.

The discharging opening 11, as shown in FIG.2, comprises an upper plate 12 and a lower plate 13. Behind the upper plate 12 is provided a fixing member 14 for guiding the discharging air flow when rotating the fan 16, and for reducing the noise. A condensed water collecting portion 12*c* is formed on the upper surface of the upper plate 12 adjacent to the lower end of the heat exchanger 15. The water collecting portion 12*c* is for collecting the condensed water generated during the heat exchange cycle.

Further, the vertical swing louver 19 is provided at the outlet or front portion of the discharging opening 11, while the horizontal swing louver 20 is provided at the inlet, or rear portion of the discharging opening 11 as shown in FIG. 1. The vertical swing louver 19 is hingedly mounted along the longitudinal direction of the discharging opening 11, that is, a direction perpendicular to the plane of the paper in FIG. 1. Preferably, two vertical swing louvers 19 are employed to adapt the vertical width of the discharging opening 11. Pin 19P protrudes from each end of the vertical swing louvers 19, and the pins 19P are inserted into respective side walls of the discharging opening 11 for forming axes enabling the vertical swing louvers 19 to be swing vertically.

Further, a plurality of the horizontal swing louvers 20 are pivotedly mounted about axes oriented perpendicularly to the longitudinal direction of the discharging opening 11, that is, axes extending from the upper left to the lower right in FIG. 1. A plurality of openings 13*a* are formed in the lower plate 13, while at a lower end of each horizontal swing louver 20 is formed a lower pin 22 for being pivotedly mounted in the opening 13*a*. At the upper end of each horizontal swing louver 20 an upper pin 21 protrudes coaxilly to the lower pin 22. In the upper plate 12 and the fixing member 14 detachedly assembled with the upper plate 12 are formed respective pin support recesses 12*a*, 14*a* for rotatably supporting the each upper pin 21.

Also, a connecting member 30 for connecting each upper pin 21 is provided to simultaneously move a set of the horizontal swing louvers 20. The connecting member 30 comprises protruded bars 31 projecting from respective upper pins and toward the fixing member 14, and a connecting bar 32 united with the protruded bars 31. The connecting bar 32 is joined to the protruded base 31 by non-rigid connections defined by respective reduced-thickness portions 33 which provide flexibility to enable the protrusions 31 to move relative to the bar 32 when the horizontal swing louvers 20 are swung around an axis defined by the upper pin 21 and the lower pin 22. When that occurs, the bar connecting 32 is horizontally moved forward or backward in the innerside space 14*c* of the fixing member 14.

Figure 3:
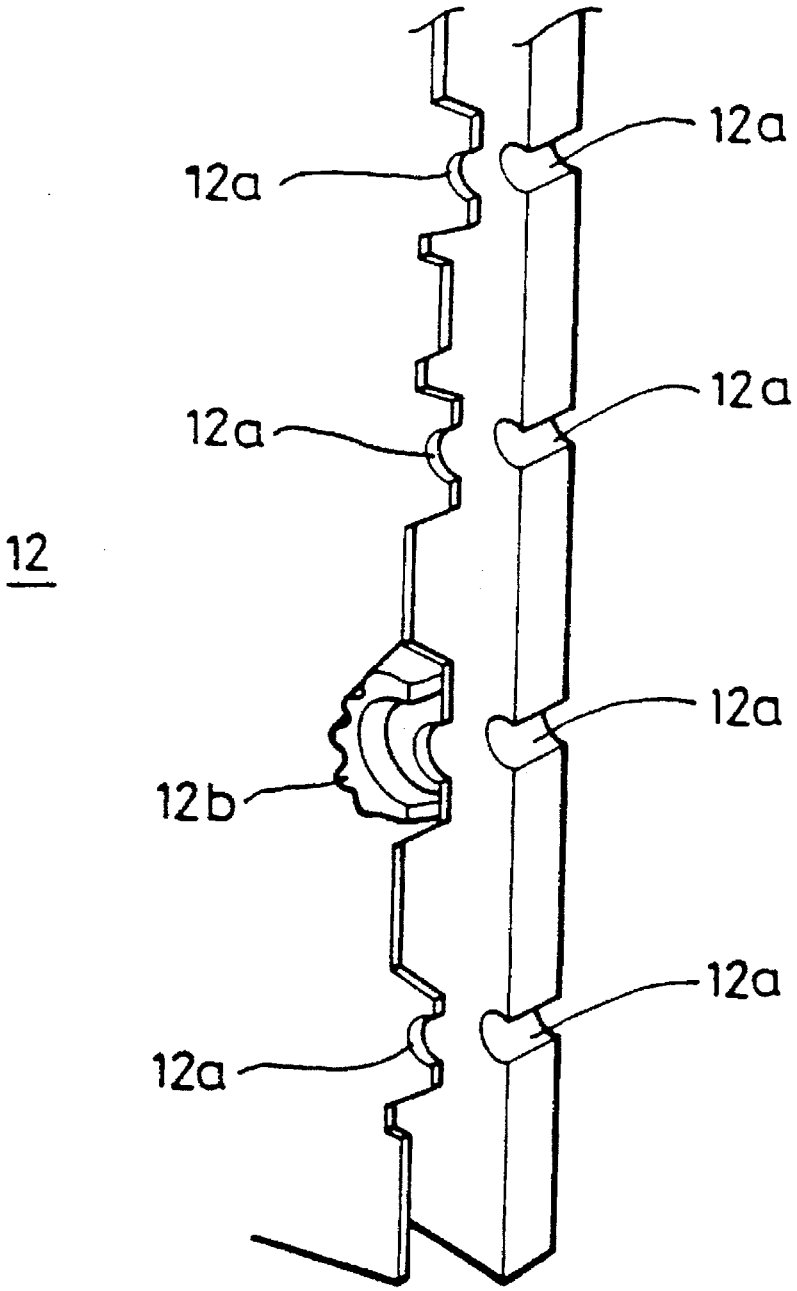
FIG. 3 is a perspective view of the upper plate of the air vent control apparatus of FIG. 2.
Figure 4:
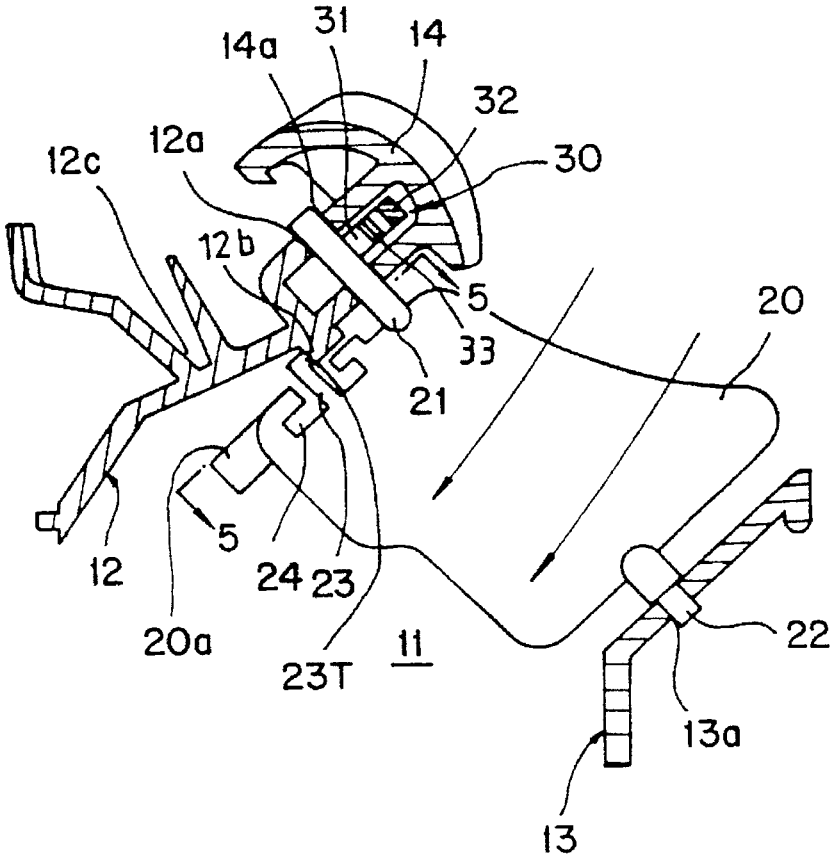
FIG. 4 is a vertical sectional view of the air vent control apparatus of FIG. 2.
Figure 5:
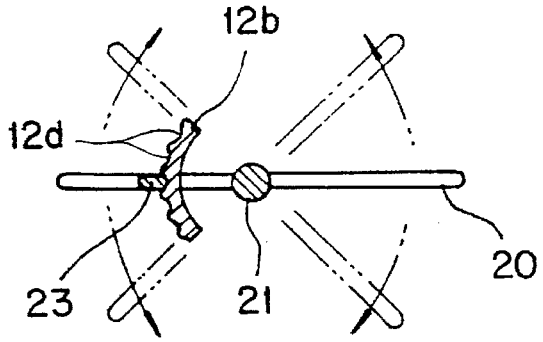
FIG. 5 is a view taken along line 5—5 of FIG. 4.
Figure 6:
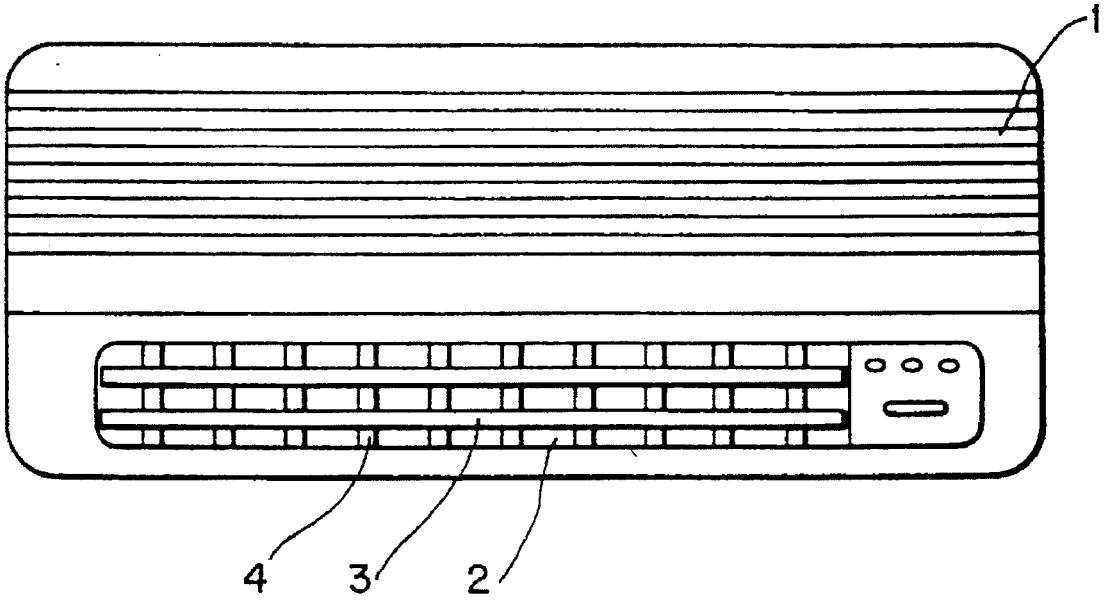
FIG. 6 (PRIOR ART)
FIG. 6 is a front view of a conventional air conditioner.
Figure 7:
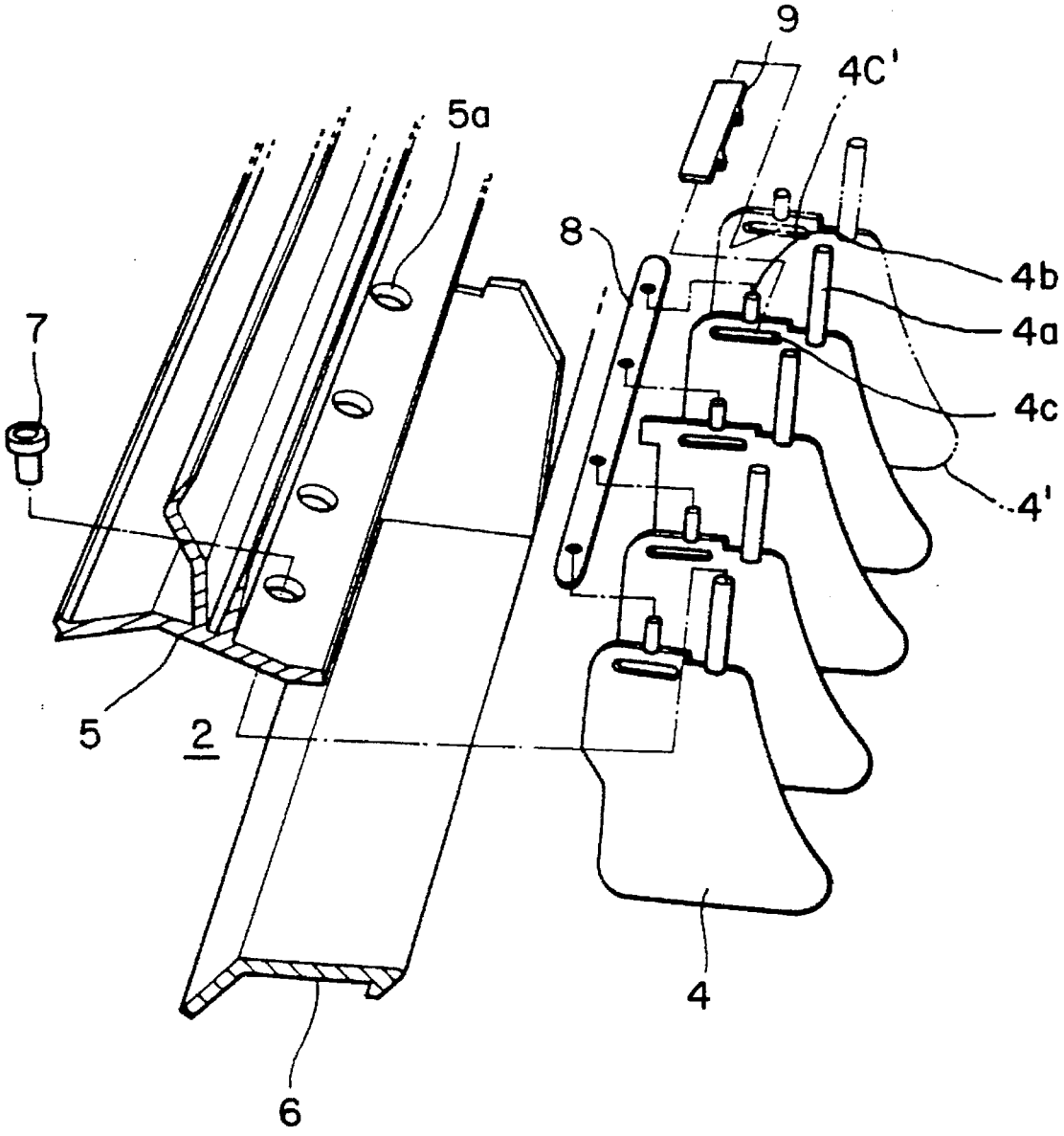
FIG. 7 (PRIOR ART)
FIG. 7 is a perspective exploded view of the air vent control apparatus according to the prior art.

At the rear surface of the upper plate 12 are provided a plurality of circular necks 12*b* having a predetermined radius and encompassing the pin supporting recess 12*a* as shown in FIG. 3. There is a neck 12*b* for each of the horizontal swing louvers 20. At the upper portion of the horizontal swing louvers 20 are formed pins 23 for being releasably engageable with grooves 12*d* formed in a convex surface of the respective necks 12*b* as shown in FIG. 4 and 5. The convex surface is coaxial with the axis of the respective hinge pin as can be seen in FIG. 5. At the upper left portion of the horizontal swing louver 20 is formed a manual handle 20*a* for swinging the louvers 20 and enable a lateral tip 23T of the pin 23 to be inserted under tension with selective grooves 12*d* of the neck 12*b*.

A space 24 is provided at each pin 23. The space 24 is needed for providing simultaneous movement of a set of the horizontal swing louvers 20. One end of an auxiliary connecting member 24*a* (FIG. 2) is coupled with the pin 23 of one louver of a set of the horizontal swing louvers 20 and is disposed in the space 24 of that louver. The other end of the auxiliary connecting member 24*a* is coupled with the pin 23' of a louver of a neighboring set of the horizontal swing louvers 20' and is disposed in the space 24' of that louver. Thus, the manual movement of the set of the horizontal swing louvers 20 is transferred to the neighboring set of the horizontal swing louvers 20'.

Alternatively, the number 24*a* could be longitudinally reciprocated by a motor, to swing every horizontal swing louver 20 simultaneously.

The air vent control apparatus built as described above is assembled as follows. First, the lower pins 22 of respective horizontal swing louvers 20 are fitted into respective openings 13*a* of the lower plate 13. Thereafter, with each connecting member 32 connected to a set of pins 21 and disposed within the innerside space 14*c* of the fixing bar 14, the circumferential rear portion, i.e. the right hand portion of FIG. 2, of each pin 21 is contacted by the surface of the pin supporting recesses 14*a*. The circumferential front portion, i.e. the left hand portion of FIG. 2, of each pin 21 is contacted by the surface of the pin supporting recesses 12*a* formed in the upper plate 12. Meanwhile, a protrusion (not shown) and a recess (not shown) can be respectively provided on the fixing member 14 and the upper plate 12 to help interconnect the fixing member 14 and the upper plate 12. To complete the assembly of the apparatus, the vertical swing louvers 19 are inserted into both side walls.

In the air vent control apparatus assembled as described above, when the fan 16 rotates, the indoor air is drawn toward the heat exchanger 15 through the intaking opening 10. The air passes through the heat exchanger 15 in which a low temperature and pressure refrigerant gas circulates and the temperature of the air is reduced.

When the direction of the air flow is intended to be changed, the vertical swing louvers 19 or the horizontal swing louvers 20 are adjusted in a desired direction. The horizontal swing louvers 20 are swung by the handle 20*a* about the axis defined by the upper 21 and the lower pin 22. Because respective upper pins 21 of a set of louvers are connected with the connecting bar 32, all swing louvers of that set are simultaneously moved in the same direction when one swing louver is swung. Furthermore, since the connecting bar 32 is connected to the protrusion bars 31 of the pins 21 by the flexible portions 33, the connecting bar 32 is moved forward or backward along the horizontal direction of the innerside space 14*c* of the fixing member 14 when the protrusion rotate about their own axes. The connecting member 32 disposed in the innerside space 14*c* does not interfere with air flow. Meanwhile, since the pins 23 are inserted under tension within the grooves 12*d* of respective necks 12*b* as shown FIG. 5 during successive swings of the horizontal swing louvers 20, adjusted state is maintained unless an external force is provided after the adjusting process.

According to the structure of the air vent control apparatus, the connecting member is not exposed to the discharge air flow because the connecting member is encircled by the upper plate and the fixing member. Thus, the velocity of discharged air cannot be reduced by connecting member. Further, no noise is generated since the discharged air does not blow against an obstacle such as the connecting member, etc. Thus, the noise generated when discharging the air is reduced. Furthermore, since the lower pins of the horizontal swing louvers are slidingly fitted into the openings of the lower plate, and the upper pins are slidingly fitted into the pin supporting recesses formed by the upper plate and the fixing member, it is not necessary to forcedly fit the pins. Hence, an accurate horizontal swing is achieved without the generation of assembly error. Consequently, a simple assembly process is achieved, and the time of the assembly is reduced, thereby increasing manufacturing productivity.

What is claimed is:

1. An air vent control apparatus for controlling a direction of air flow through a passage, comprising:

a series of louvers disposed in said passage;

a housing including a louver support;

hinge pins carried by respective louvers and mounted in said louver support for rotation about parallel axes of rotation; and a connecting member interconnecting a plurality of said hinge pins for common rotation so that rotation of one hinge pin is transmitted to the remaining hinge pins by said connecting member;

each hinge pin connected to said connecting member by a protrusion which is fixedly connected to said connecting member and its respective hinge pin, said protrusion including a reduced thickness region between its ends defining a non-rigid connection enabling said pins to rotate relative to said connecting member.

2. The air vent control apparatus according to claim 1 wherein said louver support includes a pair of fitting components each including cooperating recesses which form openings that receive said hinge pins when said fitting components are coupled together.

3. The air vent control apparatus according to claim 1 wherein said connecting member is shielded from the air flow by a member extending across a side of said connecting member facing in an upstream direction.

4. The air vent control apparatus according to claim 1 further including setting means for releasably securing said louvers in respective positions of rotation.

5. The air vent control apparatus according to claim 4 wherein said setting means comprises at least one curved element fixed to said housing and including a convex surface forming a plurality of spaced grooves, one of said louvers including a protrusion arranged to enter said grooves as said one louver rotates, said convex surface being coaxial with said axis of said hinge pin of said one louver.

6. The air vent control apparatus according to claim 1 wherein said louvers are arranged to swing horizontally back and forth.

7. An air vent control apparatus for controlling a direction of air flow through a passage, comprising:

a series of louvers disposed in said passage;

a housing including a louver support;

hinge pins carried by respective louvers and mounted in said louver support for rotation about parallel axes of rotation;

a connecting member interconnecting a plurality of said hinge pins for common rotation so that rotation of one hinge pin is transmitted to the remaining hinge pins by said connecting member; and setting means for releasably securing said louvers in respective positions of rotation, said setting means comprising at least one curved element fixed to said housing and including a convex surface forming a plurality of spaced grooves, one of said louvers including a protrusion arranged to enter said grooves as said one louver rotates, said convex surface being coaxial with said axis of said hinge pin of said one louver.

* * * * *